US009869140B2

(12) United States Patent
Rushton

(10) Patent No.: US 9,869,140 B2
(45) Date of Patent: Jan. 16, 2018

(54) STEERING SYSTEM FOR DRILL STRING

(71) Applicant: Schlumberger Technology Corporation, Sugar land, TX (US)

(72) Inventor: Guy James Rushton, Frocester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 281 days.

(21) Appl. No.: 14/709,421

(22) Filed: May 11, 2015

(65) Prior Publication Data

US 2016/0002978 A1 Jan. 7, 2016

Related U.S. Application Data

(60) Provisional application No. 62/021,470, filed on Jul. 7, 2014.

(51) Int. Cl.

| | |
|---|---|
| ***E21B 3/00*** | (2006.01) |
| ***E21B 17/10*** | (2006.01) |
| ***E21B 7/06*** | (2006.01) |

(52) U.S. Cl.
CPC ..... *E21B 17/1014* (2013.01); *E21B 7/06* (2013.01)

(58) Field of Classification Search
CPC ..... E21B 17/1014; E21B 7/04; E21B 7/06; E21B 7/062; E21B 7/067; E21B 7/104; E21B 3/00; E21B 21/10
See application file for complete search history.

(56) References Cited

U.S. PATENT DOCUMENTS

| | | | | |
|---|---|---|---|---|
| 5,113,953 | A | 5/1992 | Noble | |
| 5,265,682 | A | 11/1993 | Russell et al. | |
| 5,520,255 | A | 5/1996 | Barr et al. | |
| 5,553,678 | A * | 9/1996 | Barr | E21B 4/02 175/324 |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |

(Continued)

FOREIGN PATENT DOCUMENTS

CA 2656848 A1 9/2009

OTHER PUBLICATIONS

First Office Action and Search Report Issued in Chinese patent application 201510385807.6 dated Mar. 1, 2017. 12 pages.

*Primary Examiner* — David L Andrews
*Assistant Examiner* — Dany E Akakpo

(57) ABSTRACT

A technique facilitates directional drilling of boreholes. A steerable system has a plurality of actuator pistons slidably mounted in a mechanical structure. The mechanical structure comprises a radially inward portion containing ports to deliver a portion of drilling mud to the plurality of actuator pistons. The mechanical structure also has a radially outward portion positioned to define a main flow passage extending longitudinally through the steerable system between the radially inward portion and the radially outward portion of the mechanical structure.

20 Claims, 3 Drawing Sheets

(56) References Cited

U.S. PATENT DOCUMENTS

| | | | | |
|---|---|---|---|---|
| 5,971,085 | A | 10/1999 | Colebrook | |
| 6,089,332 | A | 7/2000 | Barr et al. | |
| 6,092,610 | A | 7/2000 | Kosmala et al. | |
| 6,109,372 | A | 8/2000 | Dorel et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 8,302,703 | B2 | 11/2012 | Rolovic | |
| 9,016,400 | B2 | 4/2015 | Clausen et al. | |
| 9,273,522 | B2 * | 3/2016 | Hummes | E21B 17/07 |
| 2001/0052428 | A1 | 12/2001 | Larronde et al. | |
| 2002/0011359 | A1 | 1/2002 | Webb et al. | |
| 2006/0090935 | A1 * | 5/2006 | Van Steenwyk | E21B 7/068 175/73 |
| 2006/0157283 | A1 * | 7/2006 | Hart | E21B 7/061 175/76 |
| 2013/0118812 | A1 * | 5/2013 | Clausen | E21B 7/06 175/267 |
| 2016/0326805 | A1 * | 11/2016 | Gao | E21B 17/1014 |

* cited by examiner

STEERING SYSTEM FOR DRILL STRING

CROSS-REFERENCE TO RELATED APPLICATIONS

The present document is based on and claims priority to U.S. Provisional Application Ser. No. 62/021,470, filed Jul. 7, 2014, which is incorporated herein by reference in its entirety.

BACKGROUND

In many hydrocarbon well applications, a wellbore is drilled with a drilling assembly delivered downhole on a drill string. A deviated or directional wellbore may be drilled with a rotary steerable drilling system by controlling the delivery of drilling mud to a plurality of actuator pistons positioned on the steerable drilling system. The actuator pistons are located on and actuated along an outside diameter of the rotary steerable drilling system, and the main flow of drilling mud to the drill bit is directed through a bore in the center.

SUMMARY

In general, a system and methodology provide a more structurally sound steering system which may be used for directional drilling of boreholes. In some embodiments, the steering system is in the form of a rotary steerable system having a plurality of actuator pistons slidably mounted in a mechanical structure. The mechanical structure comprises a radially inward portion containing ports to deliver a portion of a drilling mud to the plurality of actuator pistons. The mechanical structure also has a radially outward portion positioned to define a main flow passage extending longitudinally through the rotary steerable system between the radially inward portion and the radially outward portion of the mechanical structure. By directing the main flow of drilling mud along a radially outlying path a larger flow area may be formed with a smaller radial extent, and the radially outward portion of the mechanical structure may be made stronger and more resistant to torque.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
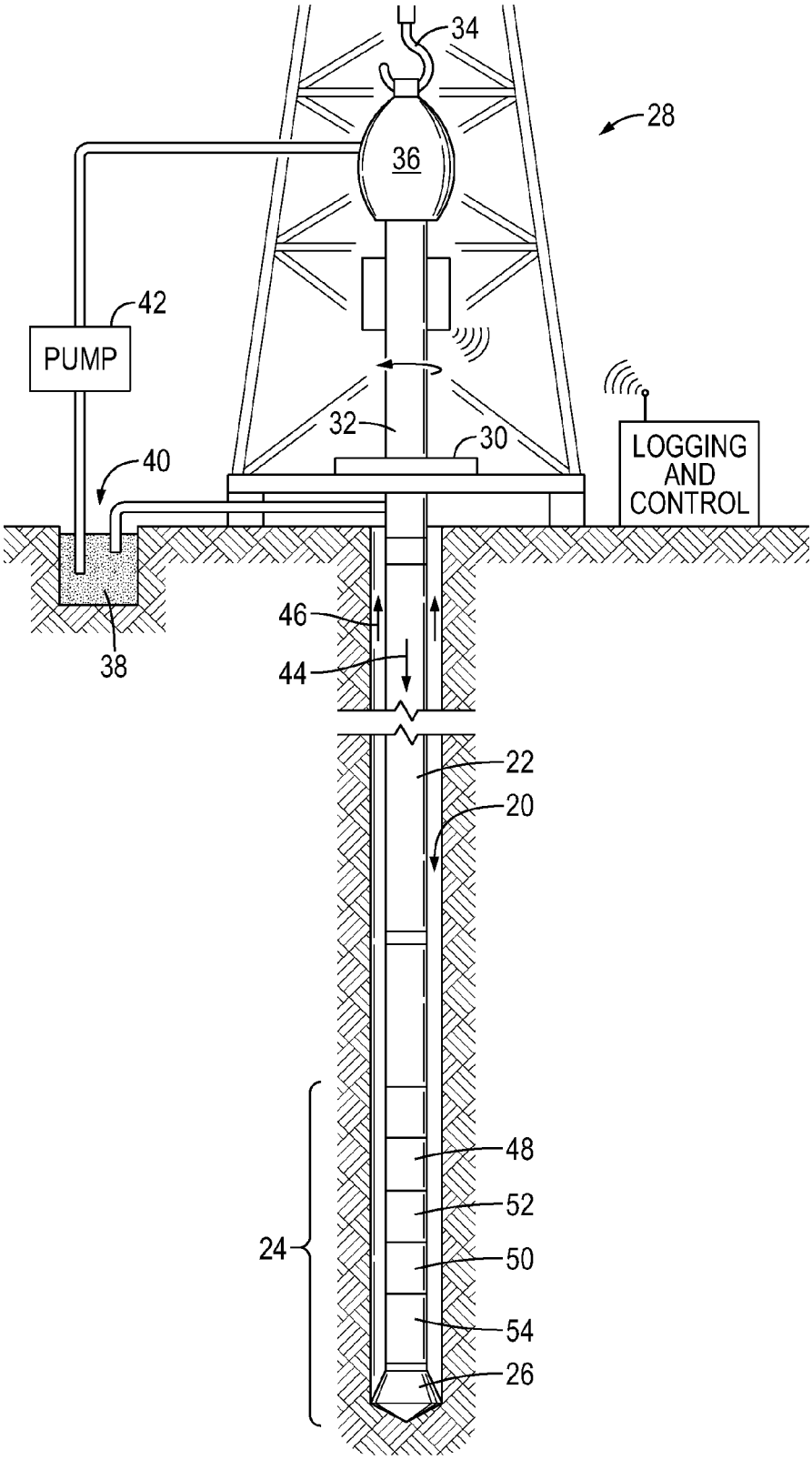
FIG. 1 is a schematic view of an example of a well system having a drill string deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which provide an improved steering system, such as an improved rotary steerable system that may be used for directional drilling of boreholes. The rotary steerable system employs a plurality of actuator pistons slidably mounted in a mechanical structure. In some applications, the plurality of actuator pistons may be used to selectively move steering pads which act to control a direction of drilling. For example, the steering pads may be selectively actuated to control the drilling of a deviated wellbore along a desired trajectory.

The mechanical structure comprises a radially inward portion which may contain ports and an associated valve system to deliver a portion of the drilling mud to the plurality of actuator pistons. The mechanical structure also has a radially outward portion and an intermediate portion which provides piston passages in which the reciprocation of the actuator pistons occurs. The mechanical structure is formed to define a main flow passage extending longitudinally through the rotary steerable system between the radially inward portion and the radially outward portion. By directing the main flow of drilling mud along a radially outlying path, a larger flow area may be formed with a smaller radial extent and the radially outward portion of the mechanical structure may be made stronger and more resistant to torque.

The outer radius of the rotary steerable system is a structurally substantial area from the point of view of resisting torque. The embodiments described herein utilize the structural properties of the material forming the mechanical structure at this larger radius. The structure described herein also allows relatively large volumes of components to be bunched on a centerline of the rotary steerable system without causing detrimental effects. For example, the flow distributing valve system and the actuating pistons may be set together near a centerline of the rotary steerable tool.

According to an embodiment of the disclosure, a valve stator housing and its flow distribution passages are combined or integrated with a mechanical structure at or near a centerline of the rotary steerable tool. In this example, the flow distribution passages take flow from the valve to the actuator pistons which, in turn, drive rotary steerable system steering pads, e.g. bit pushing pads. The system further positions and orients the piston passages so they extend into the mechanical structure at or near the centerline of the tool. This approach contrasts with conventional practice of placing the actuator pistons and piston passages at an outer radius of the rotary steerable system.

By forming such a mechanical structure and placing components at or near the centerline of the tool, material may be preserved at an outer radius to improve torsional stiffness. Additionally, the mechanical structure shifts drilling mud flow to a radially outward passage to enable a greater flow area with a smaller/shorter radial dimension of the flow passage. The greater flow area can be beneficial in reducing erosion. Additionally, the mechanical structure enables construction of very short connecting passages/ports between the valve and the actuator pistons so that better control of the inlet and exhaust flows may be obtained.

Referring generally to FIG. 1, an example of a wellsite system is illustrated in which embodiments described herein may be employed. The wellsite may be onshore or offshore. In a wellsite system, a borehole 20 is formed in subsurface formations by drilling. The method of drilling to form the borehole 20 may include, but is not limited to, rotary and directional drilling. A drill string 22 is suspended within the borehole 20 and has a bottom hole assembly (BHA) 24 that includes a drill bit 26 at its lower end.

An embodiment of a surface system includes a platform and derrick assembly 28 positioned over the borehole 20. An example of assembly 28 includes a rotary table 30, a kelly 32, a hook 34 and a rotary swivel 36. The drill string 22 is rotated by the rotary table 30, energized by a suitable system (not shown) which engages the kelly 32 at the upper end of the drill string 22. The drill string 22 is suspended from the hook 34, attached to a traveling block (not shown) through the kelly 32 and the rotary swivel 36 which permits rotation of the drill string 22 relative to the hook 34. A top drive system could be used in other embodiments.

An embodiment of the surface system also includes a drilling fluid 38, e.g., mud, stored in a pit 40 formed at the wellsite. A pump 42 delivers the drilling fluid 38 to the interior of the drill string 22 via one or more ports in the swivel 36, causing the drilling fluid to flow downwardly through the drill string 22 as indicated by directional arrow 44. The drilling fluid exits the drill string 22 via one or more ports in the drill bit 26, and then circulates upwardly through the annulus region between the outside of the drill string 22 and the wall of the borehole, as indicated by directional arrows 46. In this manner, the drilling fluid lubricates the drill bit 26 and carries formation cuttings and particulate matter up to the surface as it is returned to the pit 40 for recirculation.

The illustrated embodiment of bottom hole assembly 24 includes one or more logging-while-drilling (LWD) modules 48/50, one or more measuring-while-drilling (MWD) modules 52, one or more roto-steerable systems and motors (not shown), and the drill bit 26. It will also be understood that more than one LWD module and/or more than one MWD module may be employed in various embodiments, e.g. as represented at 48 and 50.

The LWD module 48/50 is housed in a type of drill collar, and includes capabilities for measuring, processing, and storing information, as well as for communicating with the surface equipment. The LWD module 48/50 also may include a pressure measuring device and one or more logging tools.

The MWD module 52 also is housed in a type of drill collar, and includes one or more devices for measuring characteristics of the drill string 22 and drill bit 26. The MWD module 52 also may include one or more devices for generating electrical power for the downhole system. In an embodiment, the power generating devices include a mud turbine generator (also known as a "mud motor") powered by the flow of the drilling fluid. In other embodiments, other power and/or battery systems may be employed to generate power.

The MWD module 52 also may include one or more of the following types of measuring devices: a weight-on-bit measuring device, a torque measuring device, a vibration measuring device, a shock measuring device, a stick slip measuring device, a direction measuring device, and an inclination measuring device.

In an operational example, the wellsite system of FIG. 1 is used in conjunction with controlled steering or "directional drilling." Directional drilling is the intentional deviation of the wellbore from the path it would naturally take. In other words, directional drilling is the steering of the drill string 22 so that it travels in a desired direction. Directional drilling is, for example, useful in offshore drilling because it enables multiple wells to be drilled from a single platform. Directional drilling also enables horizontal drilling through a reservoir. Horizontal drilling enables a longer length of the wellbore to traverse the reservoir, which increases the production rate from the well.

A directional drilling system also may be used in vertical drilling operation. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

Directional drilling may employ the use of a rotary steerable system ("RSS"). In an embodiment that employs the wellsite system of FIG. 1 for directional drilling, a steerable tool or subsystem 54 is provided. The steerable tool 54 may comprise an RSS. In an RSS, the drill string may be rotated from the surface and/or from a downhole location, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In an example of a "point-the-bit" rotary steerable system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition for a curve to be generated. This may be achieved in a number of different ways, including a fixed bend at a point in the bottom hole assembly close to the lower stabilizer or a flexure of the drill bit drive shaft distributed between the upper and lower stabilizer. In its idealized form, the drill bit does not have to cut sideways because the bit axis is continually rotated in the direction of the curved hole. Examples of "point-the-bit" type rotary steerable systems and their operation are described in U.S. Pat. Nos. 6,394,193; 6,364,034; 6,244,361; 6,158,529; 6,092,610; and 5,113,953; and U.S. Patent Application Publication Nos. 2002/0011359 and 2001/0052428.

In an example of a "push-the-bit" rotary steerable system, there is no specially identified mechanism that deviates the bit axis from the local bottom hole assembly axis. Instead, the non-collinear condition is achieved by causing either or both of the upper or lower stabilizers to apply an eccentric force or displacement in a direction that is orientated with respect to the direction of hole propagation. This may be achieved in a number of different ways, including non-rotating (with respect to the hole) eccentric stabilizers (displacement based approaches) and eccentric actuators that apply force to the drill bit in the desired steering direction. Steering is achieved by creating non co-linearity between the drill bit and at least two other touch points. In its idealized form, the drill bit does not have to cut sideways to generate a curved hole. Examples of "push-the-bit" type rotary steerable systems and their operation are described in U.S. Pat. Nos. 6,089,332; 5,971,085; 5,803,185; 5,778,992; 5,706,905; 5,695,015; 5,685,379; 5,673,763; 5,603,385; 5,582,259; 5,553,679; 5,553,678; 5,520,255; and 5,265,682.

Figure 2:
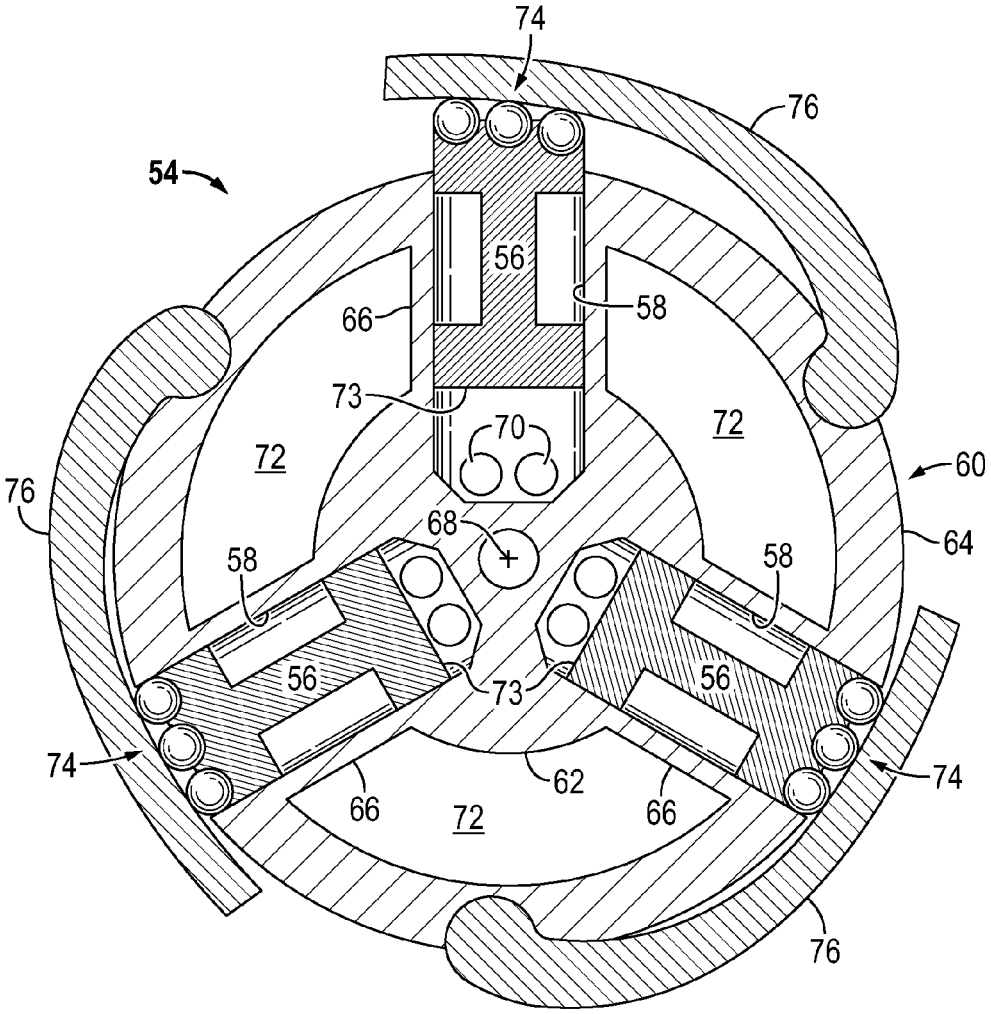
FIG. 2 is a cross-sectional view of an example of a rotary steerable system for directional drilling of a borehole, according to an embodiment of the disclosure.

Referring generally to FIG. 2, an example of steerable system 54 is illustrated. In this embodiment, steerable system 54 is a rotary steerable system having a plurality of actuator pistons 56, e.g. three actuator pistons 56. The actuator pistons 56 are slidably mounted in corresponding piston passages 58, e.g. corresponding cylinder bores, formed in a mechanical structure 60. The mechanical structure 60 comprises a radially inward portion 62, a radially outward portion 64, and an intermediate or piston chamber portion 66 extending radially between the radially inward portion 62 and the radially outward portion 64. The piston chamber portion 66 contains the piston passages 58 in which the actuator pistons 56 reciprocate radially under the influence of actuating fluid 38, e.g. drilling mud.

The radially inward portion 62 of mechanical structure 60 is constructed to position various components at or proximate an axis or centerline 68 of the rotary steerable system 54. For example, the radially inward portion 62 may contain ports 70 to deliver a portion of the drilling mud flowing through the rotary steerable system 54 to the appropriate actuator pistons 56. The radially inward portion 62 also may work in cooperation with a valve system, as explained in greater detail below with reference to FIG. 3. Radially outside of inward portion 62, the mechanical structure 60 defines a main flow passage 72 extending longitudinally through the rotary steerable system 54 at a location radially between the radially inward portion 62 and the radially outward portion 64. The main flow passage 72 directs the flow of actuating fluid 38, e.g. drilling mud, through the rotary steerable system 54 and down to, for example, drill bit 26. Because the main flow passage 72 is located radially outside of inward portion 62, a greater flow area is provided through main flow passage 72 with less of a radial extent, i.e. less radial height of passage 72, compared with routing the actuating mud along centerline 68, as with conventional systems.

The illustration in FIG. 2 is a cross-sectional view taken perpendicular to centerline 68 along a plane through actuator pistons 56. The flow to and from the actuator pistons 56 may be controlled by valve elements located in planes before and/or after the illustrated cross-sectional plane. The base of each actuator piston 56 is near the centerline 68 and bottom dead center to give a longer piston length for increased stability under load. In some applications, for example, the base or at least a portion 73 of each actuator piston 56 may move radially inward to a position radially inward of main flow passage 72. The actuator pistons 56 also may be constructed with greater length to provide more space for effective sealing of each piston 56.

A cam follower arrangement 74 may be located at the top of each actuator piston 56 to further reduce or remove side loads as each actuator piston 56 drives a corresponding actuator steering pad or plate 76. The cam follower arrangement 74 may comprise, for example, rolling balls or cylindrical elements which operate to reduce the side loads on the corresponding actuator piston 56 as the piston 56 acts against the steering pad 76. By way of example, each steering pad 76 may be pivotably coupled with the radially outward portion 64 of mechanical structure 60, as illustrated.

Figure 3:
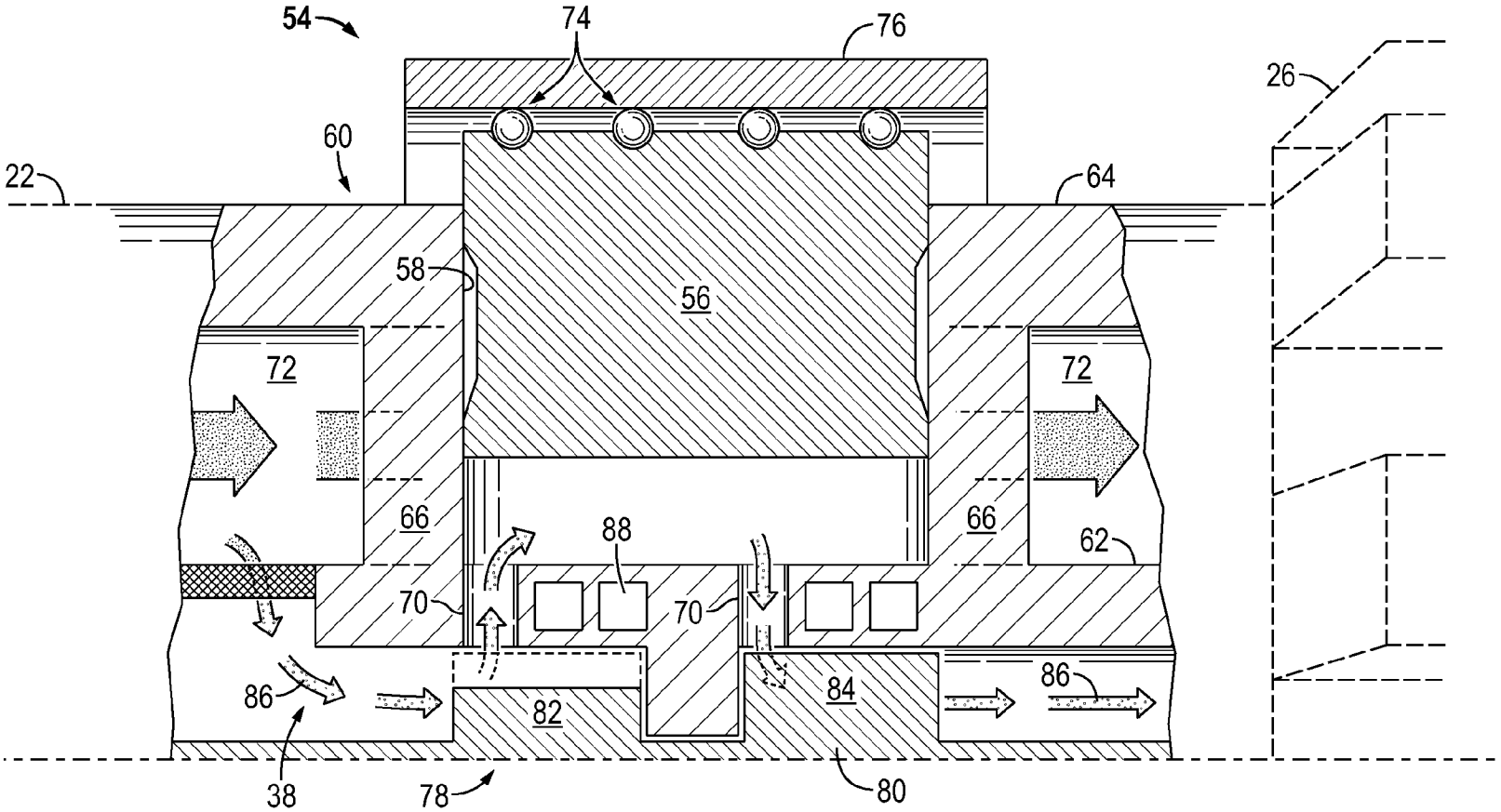
FIG. 3 is a cross-sectional view of the example illustrated in FIG. 1 but taken along a plane extending along an axis of the rotary steerable system, according to an embodiment of the disclosure.

Referring generally to FIG. 3, a cross-sectional view of the rotary steerable system 54 is illustrated in which the cross-sectional plane extends along centerline 68. In this example, the rotary steerable system 54 is part of drill string 22 constructed to rotate drill bit 26 used to drill a desired borehole, e.g. a wellbore. As illustrated, the rotary steerable system 54 comprises a valve system 78 positioned along or within radially inward portion 62 of mechanical structure 60. The valve system 78 supplies and removes actuating fluid 38, e.g. drilling mud, from the base of each piston passage 58 to enable actuation of selected actuator pistons 56. The lower portion of each piston passage 58, e.g. each piston bore, may be constructed to effectively scour away particles that have passed upstream filters.

The valve system may further be constructed and positioned to provide a unidirectional flow through ports 70, i.e. into piston passage 58 through a corresponding inlet port 70 and out of piston passage 58 through a corresponding outlet port 70. The unidirectional flow assists in the particle scouring process by moving the particles past to the actuator pistons 56. As further illustrated in FIG. 3, the valve system 78 may employ a rotor system 80 having an inlet rotor 82 and an exhaust rotor 84. The inlet rotor 82 is rotated to control flow of fluid into piston passage 58 of each actuator piston 56 via the corresponding inlet port 70. The exhaust rotor 84 is positioned on rotor system 80 to control flow of fluid out of piston passage 58 via the corresponding outlet port 70, as illustrated by arrows 86 in FIG. 3. In some embodiments, the rotor system 80 operates with a collector chamber 88.

The actuator pistons 56 may be cylindrical, i.e. circular in cross-section, and each steering pad 76 may be associated with a single actuator piston 56 or with a plurality of actuator pistons 56. For example, a plurality of cylindrical actuator pistons 56 may be arranged on successive axial planes for action against an individual, corresponding steering pad 76. Each group of pistons 56 works against the same corresponding steering pad/actuator plate 76 to improve, e.g. increase, the force generated by the system.

In another example, the actuator pistons 56 are non-circular pistons. By way of example, the non-circular actuator pistons 56 may have various cross-sectional forms, including an ellipse, a circle ended with straight sides, a rectangular or nearly rectangular shape, or other cross-sectional shapes having geometries selected to facilitate motion stability, strength, and/or other performance parameters.

Depending on the application, the rotary steerable system 54 may comprise a variety of other features and arrangements. For example, valve system 78 is illustrated as positioned beneath or radially inward of the actuator pistons 56, but the valve system can be axially displaced to either side of the plurality of actuator pistons 56. Additionally, a filter arrangement may be integrated with the valve system 78 and/or mechanical structure 60. The filter arrangement may be positioned in the flow of actuating mud used to actuate pistons 56 so as to remove potentially damaging particles. However, the filtering may be performed at other locations so that clean actuating fluid/mud may be supplied to actuator pistons 56. Additionally, the bias unit illustrated as mechanical structure 60 may be constructed in a single size. However, the gauge of the structure can be altered to match different bit sizes by, for example, the addition of abrasion resistant gauge plates on the outer faces of the steering pads.

Accordingly, system 54 may have a variety of configurations comprising other and/or additional components. For example, various types of actuator pistons and corresponding steering pads may be employed. Additionally, many types of valve systems, cam assemblies, porting arrangements, and flow passages may be used in a given rotary steerable system 54 depending on the parameters of a given structure or application. Depending on the application, the steering pads may be constructed to act directly against a surrounding wellbore wall or against another sleeve or movable component of the rotary steerable system.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for forming a directional borehole, comprising:

a rotary steerable system having a plurality of actuator pistons slidably mounted in a mechanical structure, the mechanical structure comprising:

a radially inward portion containing ports to deliver actuating mud to the plurality of actuator pistons;

a radially outward portion; and a piston chamber portion extending radially between the radially inward portion and the radially outward portion, the piston chamber portion having piston passages for receiving the plurality of actuator pistons, the mechanical structure defining a main flow passage extending longitudinally through the rotary steerable system between the radially inward portion and the radially outward portion for directing a flow of actuating mud to a drill bit, the piston passages extending radially inward of the main flow passage and into the radially inward portion in a radial plane perpendicular to a centerline of the mechanical structure intersecting the piston passages and the main flow passage.

2. The system as recited in claim 1, further comprising a valve system positioned radially inward of the main flow passage.

3. The system as recited in claim 1, wherein the actuator pistons act against corresponding steering pads.

4. The system as recited in claim 3, wherein the rotary steerable system further comprises cam followers located between the actuator pistons and the corresponding steering pads.

5. The system as recited in claim 1, wherein the actuator pistons have circular cross-sections.

6. The system as recited in claim 1, wherein the actuator pistons have non-circular cross-sections.

7. The system as recited in claim 1, wherein the rotary steerable system is connected into a drill string.

8. The system as recited in claim 1, wherein the plurality of actuator pistons comprises three actuator pistons.

9. The system as recited in claim 1, wherein at least a portion of each actuator piston reciprocates to a position radially inward of the main flow passage.

10. A method, comprising:

providing a rotary steerable system with a mechanical structure having a main flow passage for delivering drilling mud to a drill bit, the main flow passage being located radially outward of a radially inward portion of the mechanical structure;

positioning the rotary steerable system in a drill string;

routing drilling mud through the drill string including through the main flow passage;

using the drilling mud to operate actuator pistons of the rotary steerable system via valve controlled ports located at a radially inward position relative to the main flow passage and within the radially inward portion of the mechanical structure; and directing a remainder of the drilling mud past the rotary steerable system via the main flow passage, wherein in a radial plane perpendicular to a centerline of the mechanical structure intersecting the main flow passage and the valve controlled ports, the valve controlled ports are located radially inward of the main flow passage.

11. The method as recited in claim 10, further comprising locating a corresponding valve system in the radially inward portion of the mechanical structure.

12. The method as recited in claim 11, further comprising mounting the actuator pistons in corresponding piston passages oriented radially in the mechanical structure.

13. The method as recited in claim 12, further comprising actuating the actuator pistons to selectively move a plurality of corresponding steering pads.

14. The method as recited in claim 13, further comprising using cam followers between the actuator pistons and the corresponding steering pads.

15. The method as recited in claim 13, further comprising pivotably coupling each corresponding steering pad to the mechanical structure of the rotary steerable system.

16. The method as recited in claim 10, wherein using comprises reciprocating the actuator pistons such that a portion of each actuator piston moves to a position radially inward of the main flow passage.

17. A system for steering during drilling, comprising:

a drill string having a rotary steerable system, the drill string being constructed to enable a flow of drilling mud therethrough, the rotary steerable system comprising:

a plurality of actuator pistons operated within corresponding piston passages by the flow of drilling mud;

a plurality of ports located at a radially inward position within the rotary steerable system, the ports of the plurality of ports being positioned to direct flow of the drilling mud to corresponding actuator pistons of the plurality of actuator pistons; and a mechanical structure having, in a radial plane perpendicular to a centerline of the rotary steerable system, a main flow passage located radially outward of the plurality of ports and radially outward of radially inward portions of the corresponding piston passages, the main flow passage directing a remainder of the drilling mud past the rotary steerable system.

18. The system as recited in claim 17, wherein the rotary steerable system further comprises a corresponding valve system to control flow of the drilling mud to selected ports of the plurality of ports, the plurality of ports and the corresponding valve system being located in a radially inward portion of the mechanical structure.

19. The system as recited in claim 18, wherein the actuator pistons move within corresponding piston passages oriented radially in the mechanical structure.

20. The system as recited in claim 19, wherein the rotary steerable system further comprises a plurality of corresponding steering pads, the actuator pistons being actuated to move selected, corresponding steering pads.

* * * * *